US007677709B2

(12) United States Patent
Kojima

(10) Patent No.: US 7,677,709 B2
(45) Date of Patent: Mar. 16, 2010

(54) LIQUID EJECTION HEAD AND IMAGE FORMING APPARATUS

(75) Inventor: Toshiya Kojima, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 332 days.

(21) Appl. No.: 11/235,352

(22) Filed: Sep. 27, 2005

(65) Prior Publication Data

US 2006/0066692 A1 Mar. 30, 2006

(30) Foreign Application Priority Data

Sep. 28, 2004 (JP) ..... 2004-282649

(51) Int. Cl.
*B41J 2/045* (2006.01)

(52) U.S. Cl. ..... 347/72

(58) Field of Classification Search ..... 347/70–72
See application file for complete search history.

(56) References Cited

U.S. PATENT DOCUMENTS

| | | | | |
|---|---|---|---|---|
| 6,053,602 A * | 4/2000 | Noto et al. | ..... | 347/70 |
| 6,109,728 A * | 8/2000 | Kakuda et al. | ..... | 347/45 |
| 6,176,571 B1 * | 1/2001 | Kishima et al. | ..... | 347/68 |
| 7,044,586 B2 * | 5/2006 | Takeuchi et al. | ..... | 347/68 |

FOREIGN PATENT DOCUMENTS

| | | | |
|---|---|---|---|
| JP | 6-188472 A | | 7/1994 |
| JP | 06188472 A | * | 7/1994 |
| JP | 9-290506 A | | 11/1997 |
| JP | 2000-334949 A | | 12/2000 |
| JP | 2001-10050 A | | 1/2001 |

* cited by examiner

*Primary Examiner*—Matthew Luu
*Assistant Examiner*—Lisa M Solomon
(74) *Attorney, Agent, or Firm*—Birch, Stewart, Kolasch, & Birch, LLP.

(57) ABSTRACT

The liquid ejection head comprises: a nozzle through which liquid is ejected; a pressure chamber which is connected to the nozzle; a diaphragm which pressurizes the pressure chamber; and a laminated piezoelectric element which causes the diaphragm to deform and is formed on the diaphragm by means of a thin film forming technique, wherein: an effective surface area of the diaphragm forming one inner surface of the pressure chamber is greater than a surface area of a bonding section between the diaphragm and the laminated piezoelectric element; a surface area of an active section of the laminated piezoelectric element is greater than the effective surface area of the diaphragm; and the laminated piezoelectric element is formed in such a manner that a cross-sectional area of the laminated piezoelectric element perpendicular to a direction of lamination becomes smaller as receding from the diaphragm.

5 Claims, 11 Drawing Sheets

FIG.7A PUSH BY 10V
ACTUATOR: 150kHz
PRESSURE CHAMBER: 100kHz
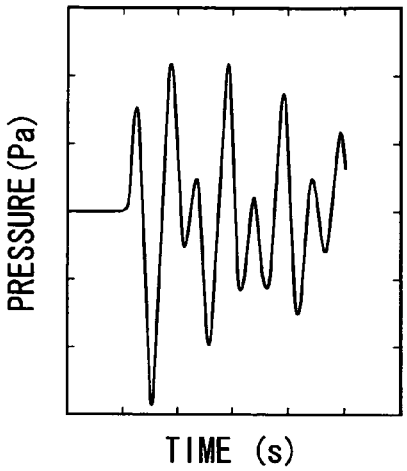
FIG.7B PUSH BY 10V
ACTUATOR: 200kHz
PRESSURE CHAMBER: 100kHz
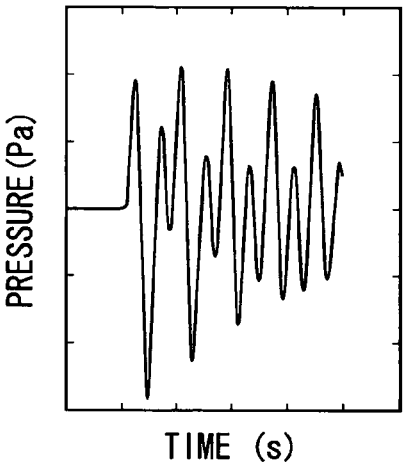
FIG.7C PUSH BY 10V
ACTUATOR: 250kHz
PRESSURE CHAMBER: 100kHz
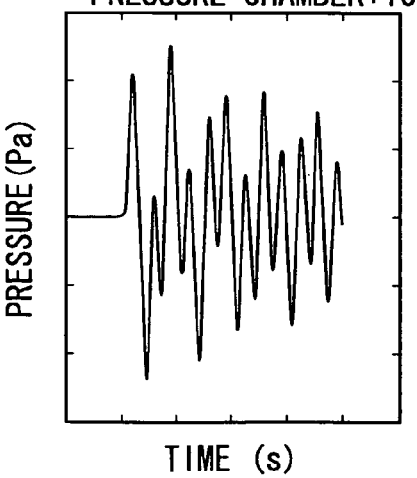
FIG.7D PUSH BY 10V
ACTUATOR: 300kHz
PRESSURE CHAMBER: 100kHz
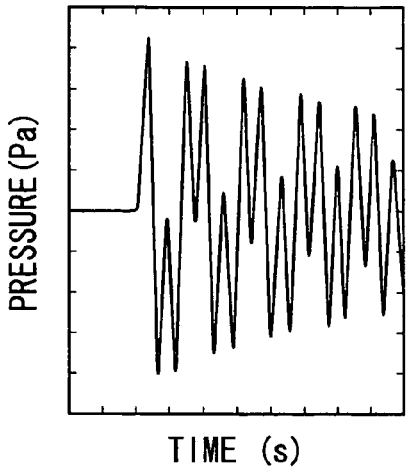
FIG.7E PUSH BY 10V
ACTUATOR: 500kHz
PRESSURE CHAMBER: 100kHz
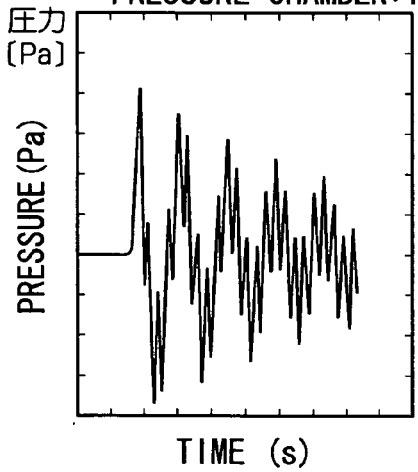
FIG.7F PUSH BY 10V
ACTUATOR: 1MHz
PRESSURE CHAMBER: 100kHz
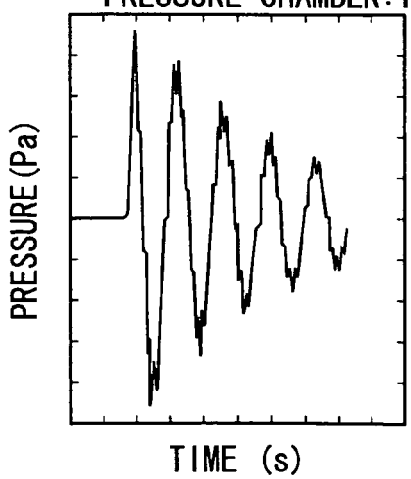

LIQUID EJECTION HEAD AND IMAGE FORMING APPARATUS

BACKGROUND OF THE INVENTION

1. Field of the Invention

The present invention relates to a liquid ejection head and an image forming apparatus, and more particularly, to a liquid ejection head and image forming apparatus whereby the bonding characteristics and reliability of a diaphragm and piezoelectric bodies are improved, and ejection force is increased.

2. Description of the Related Art

Conventionally, as an image forming apparatus, an inkjet printer (inkjet recording apparatus) is known, which comprises an inkjet head (liquid ejection head) having an arrangement of a plurality of nozzles (ejection ports) and which records images on a recording medium by ejecting ink from the nozzles toward the recording medium while causing the inkjet head and the recording medium to move relatively to each other.

In an inkjet printer of this kind, ink is supplied to pressure chambers from an ink tank, via an ink supply channel, and by driving piezoelectric elements by supplying electrical signals corresponding to the image data to the piezoelectric elements, the diaphragms constituting a portion of each pressure chamber are caused to deform, thereby reducing the volume of the pressure chamber and causing the ink inside the pressure chamber to be ejected from a nozzle in the form of a droplet.

In an inkjet recording printer, one image is formed on a recording medium by a combination of dots formed on the recording medium by ink ejected from the nozzles. In recent years, it has become desirable to form images of high quality on a par with photographic prints, in inkjet printers. It has been thought that high image quality can be achieved by reducing the size of the ink droplets ejected from the nozzles by reducing the diameter of the nozzles, while also increasing the number of pixels per image by arranging the nozzles at high density.

On the other hand, as a method of manufacturing an inkjet head, there is a method in which piezoelectric elements (piezoelectric bodies) and a diaphragm are manufactured separately and are then bonded together. In this case, with increase in nozzle density, the density and level of integration of the piezoelectric bodies formed on the pressure chambers corresponding to the nozzles have also increased, and it has been sought to achieve high accuracy of positioning when bonding piezoelectric elements with a diaphragm in this way.

As a method for achieving high positional accuracy when bonding piezoelectric elements with a diaphragm in this way, it has been proposed that recess and projection shapes be formed in either one or both of the piezoelectric elements and the diaphragm, in such a manner that reliable positional alignment can be achieved by mutually engaging the recesses and projections.

For example, a method is known in which a recess shape is provided in the bonding surface of either a laminated piezoelectric element or a pressure transmitting member for transmitting the deformation of the laminated piezoelectric element to a diaphragm, and a projecting shape is provided in the bonding surface of the other thereof, and by assembling the element and member in such a manner that these shapes are mutually engaging, variation in positional accuracy is eliminated and reliability is improved. Furthermore, by forming the bonding sections with projecting and recess shapes, only the active section of the laminated piezoelectric element transmits vibration, and therefore, it is possible to avoid decline in the displacement due to the bonding surface failing to perform sufficient movement in cases where both the active section and the inactive section of the laminated piezoelectric element make contact with the diaphragm. Consequently, displacement efficiency is improved (see, for example, Japanese Patent Application Publication No. 6-188472).

Furthermore, Japanese Patent Application Publication No. 6-188472 describes a method in which, even if there is difference between the heights of a base substrate and a pressure transmitting member, the difference in height is absorbed by an adhesive deposited on the bonding surfaces of a laminated piezoelectric element and the pressure transmitting member, and therefore the volume of the pressure chambers can be made uniform, even if there are height variations between respective members. Since the laminated piezoelectric element and the pressure transmitting member are bonded by means of an adhesive, the deformation of the piezoelectric element is transmitted to the pressure chamber, and a uniform ejection efficiency can be maintained.

Furthermore, it is also known that the reliability of a diaphragm can be improved if, for instance, a first layer comprising a thin film made from a metallic material capable of deforming due to displacement of a laminated piezoelectric element, and a second layer comprising a thick film made of metallic material are layered in a unified manner onto a diaphragm plate, the second layer only on the diaphragm plate then being etched selectively to form island-shaped projections corresponding to the laminated piezoelectric elements and diaphragm sections surrounding same, and the island-shaped projections being bonded with the drive sections (active sections) of the laminated piezoelectric elements (see, for example, Japanese Patent Application Publication No. 9-290506).

Furthermore, it is also known that a thin film diaphragm plate free of pinhole defects can be formed by, for example, etching a diaphragm plate to achieve a thin film of 10 μm or less, thereby forming diaphragm sections, and also forming island-shaped projections corresponding to the active sections of laminated piezoelectric elements, and then pressure bonding the laminated piezoelectric elements with the island-shaped projections on the diaphragm plate (see, for example, Japanese Patent Application Publication No. 2001-10050).

Moreover, for example, it is also known that, by forming island-shaped projections on a diaphragm plate, forming recess sections in the bonding surface of piezoelectric elements which are to be bonded with the diaphragm plate, aligning the positions of the island-shaped projections and the recess sections on the piezoelectric elements, and then bonding same by means of a film type adhesive, such as an epoxy thermosetting resin, which can be applied to a high degree of accuracy, then the piezoelectric elements and the diaphragm plate can be aligned in position with high accuracy, the positioning accuracy of the piezoelectric elements and the pressure chambers can be raised, and therefore it becomes possible to adapt to increased density of the nozzle pitch (see, for example, Japanese Patent Application Publication No. 2000-334949).

However, all of the above-described related arts involve forming projecting shapes or recess shapes in both the diaphragm and the piezoelectric elements, and the manufacture of these shapes brings problems of the following kinds.

For example, in Japanese Patent Application Publication Nos. 9-290506 and 2001-10050, etching is used in order to create projecting shapes in a diaphragm plate, and therefore, this processing step is complicated and production efficiency is poor. In Japanese Patent Application Publication No. 2000-334949, a wire saw is used as a device for forming recess shapes in the piezoelectric elements, but this requires a long processing time and is inefficient. Japanese Patent Application Publication No.6-188472 makes no disclosure regarding a concrete method for forming the recess and projecting shapes, and the above-described methods respectively involve the problems stated above. Although other methods might be envisaged, such as calcination followed by sandblasting, or calcination performed after forming the recess and projecting shapes, these methods require complicated post-processing steps and have poor accuracy. Moreover, performing calcination after forming the shapes will disrupt the dimensional accuracy.

SUMMARY OF THE INVENTION

The present invention has been contrived in view of the foregoing circumstances, an object thereof being to provide a liquid ejection head and image forming apparatus whereby stable ejection can be obtained, while achieving excellent bonding characteristics between the piezoelectric elements and the diaphragm and improving the reliability of the diaphragm.

In order to attain the aforementioned object, the present invention is directed to a liquid ejection head, comprising: a nozzle through which liquid is ejected; a pressure chamber which is connected to the nozzle; a diaphragm which pressurizes the pressure chamber; and a laminated piezoelectric element which causes the diaphragm to deform and is formed on the diaphragm by means of a thin film forming technique, wherein: an effective surface area of the diaphragm forming one inner surface of the pressure chamber is greater than a surface area of a bonding section between the diaphragm and the laminated piezoelectric element; a surface area of an active section of the laminated piezoelectric element is greater than the effective surface area of the diaphragm; and the laminated piezoelectric element is formed in such a manner that a cross-sectional area of the laminated piezoelectric element perpendicular to a direction of lamination becomes smaller as receding from the diaphragm.

Accordingly, the close bonding characteristics between the laminated piezoelectric element and the diaphragm are improved, the wiring of the electrodes which drive the laminate piezoelectric element can be extracted readily, and the surface area of the bonding section between the diaphragm and the laminated piezoelectric element can be made smaller than the effective surface area of the diaphragm, which is the surface area of the portion of the diaphragm which corresponds to the pressure chamber. Therefore, the diaphragm is pushed by means of a bonded section having a surface area that is smaller than then effective surface area of the diaphragm, and consequently, the pressure generated in the pressure chamber is raised, and moreover, the bonding section between the diaphragm and the laminated piezoelectric element can be positioned over the pressure chamber, even if there is some degree of positional displacement during manufacture. Accordingly, the laminated piezoelectric element can be made to push the diaphragm in a reliable manner.

Preferably, the thin film forming technique is an aerosol deposition method. Accordingly, it is possible to form a film having a very fine shape, directly onto the diaphragm.

Preferably, a plurality of laminated piezoelectric elements are integrated on diaphragm sides thereof so as to correspond to a plurality of pressure chambers. This facilitates handling of the liquid ejection head during manufacture.

Preferably, the liquid ejection head further comprises an elastic member which is disposed in a periphery of the bonding section between the laminated piezoelectric element and the diaphragm. Accordingly, it is possible to simplify the manufacturing steps.

Preferably, the bonding section between the diaphragm and the laminated piezoelectric element is formed in such a manner that the diaphragm vibrates in a third-order mode. Accordingly, it is possible to make the diaphragm vibrate at high frequency, and ejection can be stabilized by avoiding unintentional ejections after the principal ejection.

In order to attain the aforementioned object, the present invention is also directed to an image forming apparatus, comprising the above-described liquid ejection head. Accordingly, it is possible to simplify the manufacturing steps for an image forming apparatus.

According to the liquid ejection head and the image forming apparatus of the present invention, the close bonding characteristics between the laminated piezoelectric element and the diaphragm are improved, the wiring of the electrodes which drive the laminate piezoelectric element can be extracted readily, the effective surface area of the diaphragm, which is the surface area of the portion of the diaphragm which corresponds to the pressure chamber, is made greater than the surface area of the bonding section between the diaphragm and the laminated piezoelectric element, and the surface area of the active section of the piezoelectric element is made greater than the effective surface area of the diaphragm. Therefore, the diaphragm is pushed by means of a bonded section having a surface area that is smaller than then effective surface area of the diaphragm, and consequently, the pressure generated in the pressure chamber is raised, and moreover, the bonding section between the diaphragm and the laminated piezoelectric element can be positioned over the pressure chamber, even if there is some degree of positional displacement during manufacture. Accordingly, the laminated piezoelectric element can be made to push the diaphragm in a reliable manner.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIGS. 7A to 7F are graphs showing simulation results for the change in vibration in a case where an actuator is pushed by a voltage of 10V, while changing the frequency of the actuator between 150 kHz and 1 MHz, at a uniform resonant frequency of the pressure chamber;

FIGS. 8A and 8B are illustrative diagrams showing schematic views of vibration modes, in which FIG. 8A shows a first-order mode and FIG. 8B shows a third-order mode;

FIGS. 13A and 13B are illustrative diagrams showing two methods for manufacturing a laminated piezoelectric element by the method shown in FIGS. 11A to 11H, as viewed in the direction of arrow W in FIG. 12, in which FIG. 13A shows a state where respective laminated piezoelectric elements are formed separately and FIG. 13B shows a state where the lower parts of the respective laminated piezoelectric elements are integrated into a single body.

DETAILED DESCRIPTION OF THE PREFERRED EMBODIMENTS

Figure 1:
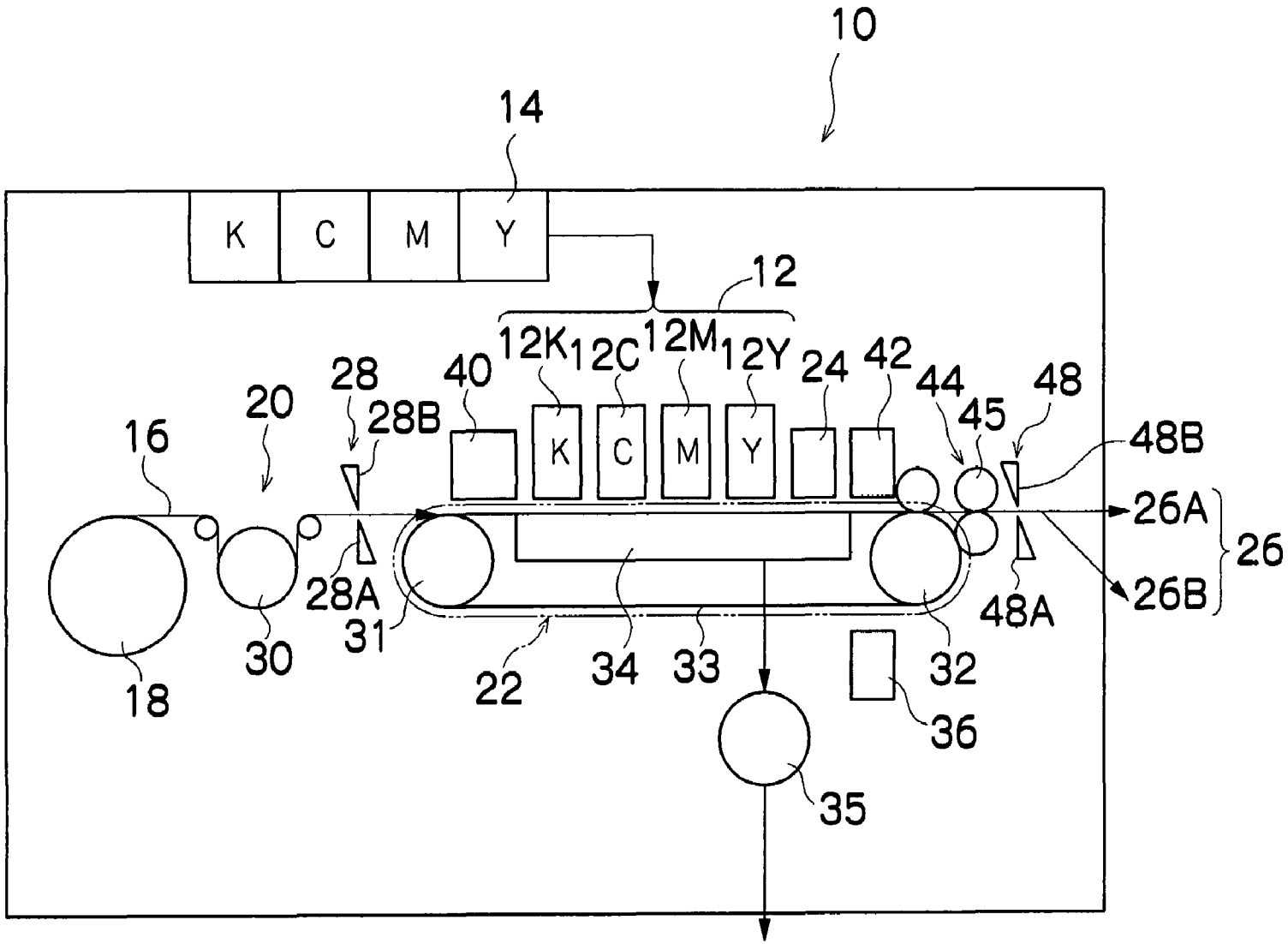
FIG. 1 is a general schematic drawing of one embodiment of an inkjet recording apparatus forming an image forming apparatus according to the present invention.

FIG. 1 is a general schematic drawing showing an approximate view of one embodiment of an inkjet recording apparatus forming an image forming apparatus having a liquid ejection head relating to the present invention.

As shown in FIG. 1, the inkjet recording apparatus 10 comprises: a printing unit 12 having a plurality of print heads (liquid ejection heads) 12K, 12C, 12M, and 12Y for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying recording paper 16; a decurling unit 20 for removing curl in the recording paper 16 supplied from the paper supply unit 18; a suction belt conveyance unit 22 disposed facing the nozzle face (ink droplet ejection face) of the print unit 12, for conveying the recording paper 16 while keeping the recording paper 16 flat; a print determination unit 24 for reading the printed result produced by the printing unit 12; and a paper output unit 26 for outputting printed recording paper (printed matter) to the exterior.

In FIG. 1, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which roll paper is used, a cutter 28 is provided as shown in FIG. 1, and the roll paper is cut to a desired size by the cutter 28. The cutter 28 has a stationary blade 28A, of which length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyance path. When cut paper is used, the cutter 28 is not required.

In the case of a configuration in which a plurality of types of paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1. The suction chamber 34 provides suction with a fan 35 to generate a negative pressure, and the recording paper 16 is held on the belt 33 by suction.

The belt 33 is driven in the clockwise direction in FIG. 1 by the motive force of a motor (not shown) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
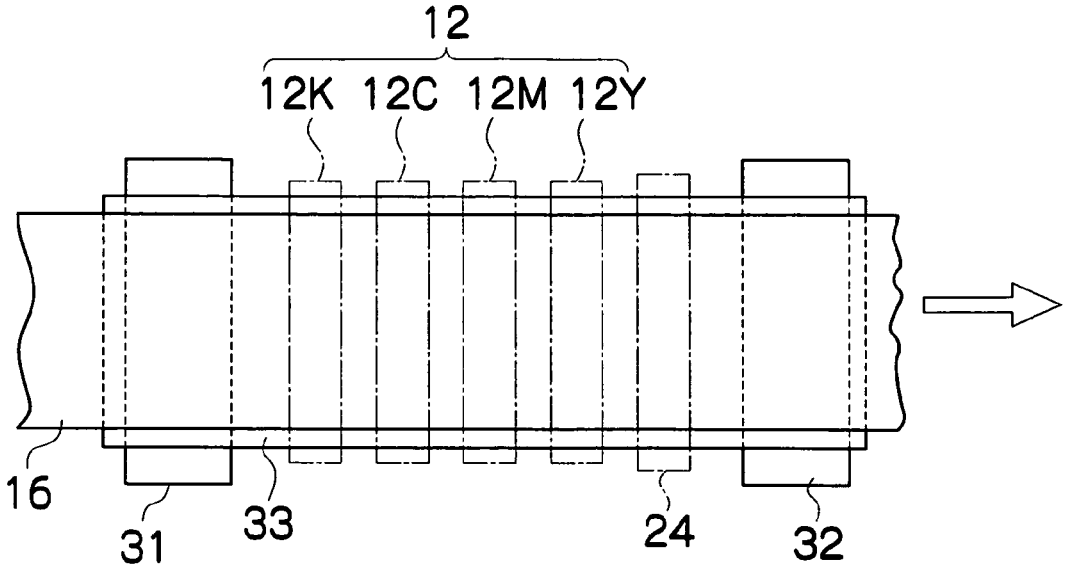
FIG. 2 is a plan view of the principal part of the peripheral area of a print unit in the inkjet recording apparatus shown in FIG. 1.

FIG. 2 is a principal plan diagram showing the periphery of the print unit 12 in the inkjet recording apparatus 10.

As shown in FIG. 2, the print unit 12 is a so-called "full line head" in which a line head having a length corresponding to the maximum paper width is arranged in a direction (main scanning direction) that is perpendicular to the paper conveyance direction (sub-scanning direction).

The print heads 12K, 12C, 12M and 12Y are constituted by line heads in which a plurality of ink ejection ports (nozzles) are arranged through a length exceeding at least one side of the maximum size recording paper 16 intended for use with the inkjet recording apparatus 10.

The print heads 12K, 12C, 12M, 12Y corresponding to respective ink colors are disposed in the order, black (K), cyan (C), magenta (M) and yellow (Y), from the upstream side (left-hand side in FIG. 1), following the direction of conveyance of the recording paper 16 (the paper conveyance direction). A color print can be formed on the recording paper 16 by ejecting the inks from the print heads 12K, 12C, 12M, and 12Y, respectively, onto the recording paper 16 while conveying the recording paper 16.

The print unit 12, in which the full-line heads covering the entire width of the paper are thus provided for the respective ink colors, can record an image over the entire surface of the recording paper 16 by performing the action of moving the recording paper 16 and the print unit 12 relatively to each other in the paper conveyance direction (sub-scanning direction) just once (in other words, by means of a single sub-scan). Higher-speed printing is thereby made possible and productivity can be improved in comparison with a shuttle type head configuration in which a recording head moves reciprocally in a direction (main scanning direction) which is perpendicular to the paper conveyance direction.

Here, the terms main scanning direction and sub-scanning direction are used in the following senses. More specifically, in a full-line head comprising rows of nozzles that have a length corresponding to the entire width of the recording paper, "main scanning" is defined as printing one line (a line formed of a row of dots, or a line formed of a plurality of rows of dots) in the breadthways direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other. The direction indicated by one line recorded by a main scanning action (the lengthwise direction of the band-shaped region thus recorded) is called the "main scanning direction".

On the other hand, "sub-scanning" is defined as to repeatedly perform printing of one line (a line formed of a row of dots, or a line formed of a plurality of rows of dots) formed by the main scanning, while moving the full-line head and the recording paper relatively to each other. The direction in which sub-scanning is performed is called the sub-scanning direction. Consequently, the conveyance direction of the reference point is the sub-scanning direction and the direction perpendicular to same is called the main scanning direction.

Although a configuration with the four standard colors, K, C, M and Y, is described in the present embodiment, the combinations of the ink colors and the number of colors are not limited to these, and light and/or dark inks can be added as required. For example, a configuration is possible in which print heads for ejecting light-colored inks such as light cyan and light magenta are added.

As shown in FIG. 1, the ink storing and loading unit 14 has tanks for storing inks of the colors corresponding to the respective print heads 12K, 12C, 12M and 12Y, and each tank is connected to a respective print head 12K, 12C, 12M, 12Y, via a tube channel (not shown). Moreover, the ink storing and loading unit 14 also comprises a notifying device (display device, alarm generating device, or the like) for generating a notification if the remaining amount of ink has become low, as well as having a mechanism for preventing incorrect loading of the wrong colored ink.

The print determination unit 24 has an image sensor (a line sensor) for capturing an image of the ink-droplet deposition result of the printing unit 12, and functions as a device to check for ejection defects such as clogs of the nozzles in the printing unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the print heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern image printed by the print heads 12K, 12C, 12M, and 12Y for the respective colors, and determines the ejection of each head. The ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Moreover, although omitted from the drawing, a sorter for collating and stacking the images according to job orders is provided in the paper output section 26A corresponding to the main images.

Figure 3:
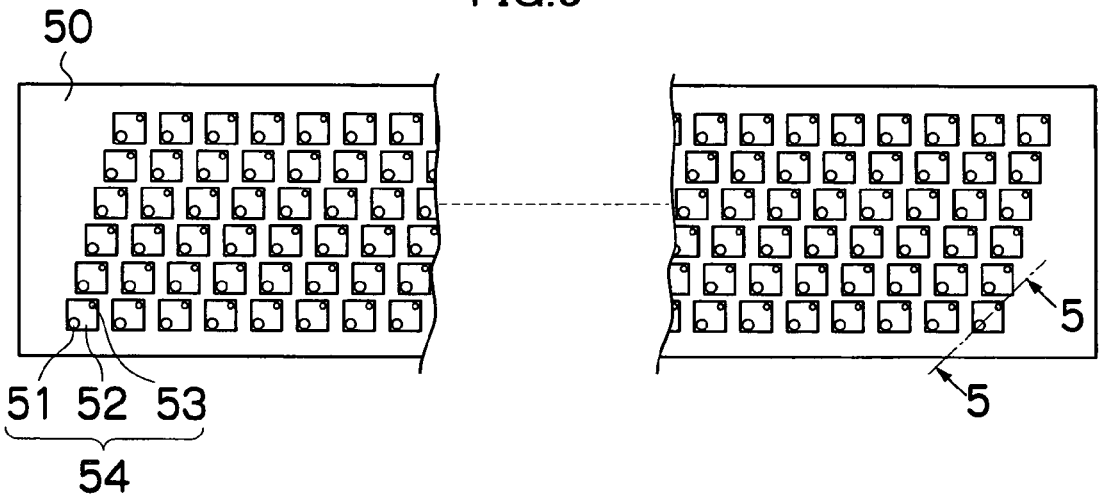
FIG. 3 is a plan perspective diagram showing an example of the structure of a print head.

Next, the arrangement of nozzles (liquid ejection ports) in the print head (liquid ejection head) will be described. The print heads 12K, 12C, 12M and 12Y provided for the respective ink colors each have the same structure, and a print head forming a representative example of these print heads is indicated by the reference numeral 50. FIG. 3 shows a plan view perspective diagram of the print head 50.

As shown in FIG. 3, the print head 50 according to the present embodiment achieves a high density arrangement of nozzles 51 by using a two-dimensional staggered matrix array of pressure chamber units 54, each constituted by a nozzle 51 for ejecting ink as ink droplets, a pressure chamber 52 for applying pressure to the ink in order to eject ink, and an ink supply port 53 for supplying ink to the pressure chamber 52 from a common flow channel (not shown in FIG. 3).

There are no particular limitations on the size of the nozzle arrangement in a print head 50 of this kind, but as one example, 2400 nozzles per inch (npi) can be achieved by arranging nozzles 51 in 48 lateral rows (21 mm) and 600 vertical columns (305 mm).

In the example shown in FIG. 3, the pressure chambers 52 each have an approximately square planar shape when viewed from above, but the planar shape of the pressure chambers 52 is not limited to a square shape. As shown in FIG. 3, a nozzle 51 is formed at one end of a diagonal of each pressure chamber 52, and an ink supply port 53 is provided at the other end thereof.

Figure 4:
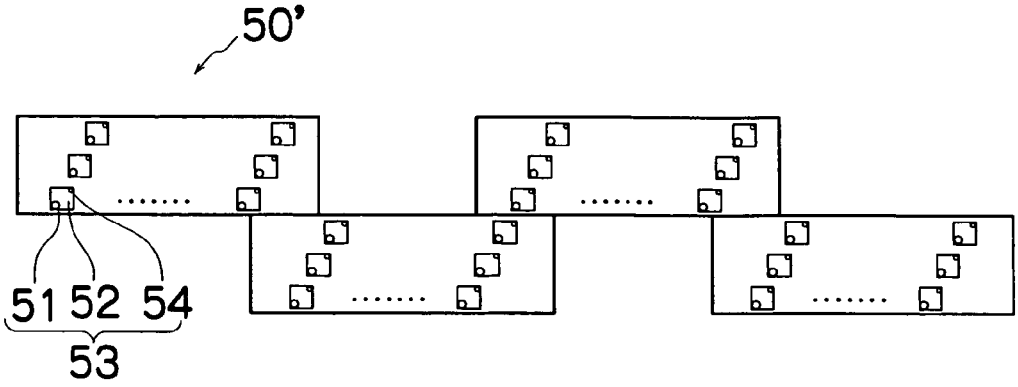
FIG. 4 is a plan view showing a further example of a print head.

Moreover, FIG. 4 is a plan view perspective diagram showing a further example of the structure of a print head. As shown in FIG. 4, one long full line head may be constituted by combining a plurality of short heads 50' arranged in a two-dimensional staggered array, in such a manner that the combined length of this plurality of short heads 50' corresponds to the full width of the print medium.

Figure 5:
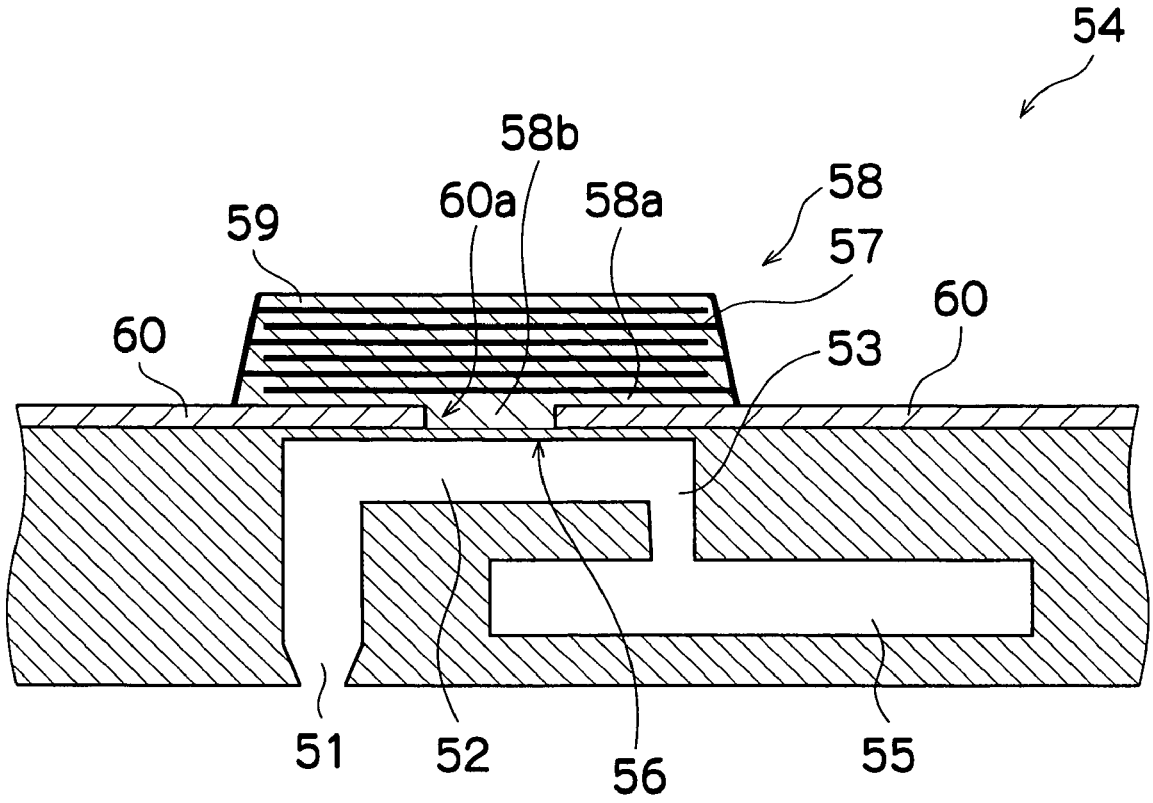
FIG. 5 shows a cross-sectional view of one pressure chamber unit along line 5-5 in FIG. 4.

FIG. 5 shows a cross-sectional view of one pressure chamber unit 54 along line 5-5 in FIG. 3. As shown in FIG. 5, each pressure chamber unit 54 is formed with a pressure chamber 52 which is connected to a nozzle 51 that ejects ink. A common flow channel 55 for supplying ink is connected to the pressure chamber 52 via an ink supply port 53, and one surface of the pressure chamber 52 (the ceiling in the diagram) is constituted by a diaphragm 56. A laminated piezoelectric element 58 which deforms the diaphragm 56 by applying pressure to the diaphragm 56 is bonded to the upper part of same. Although described in more detail below, the laminated piezoelectric element 58 is formed by alternately layering a piezoelectric body 58*a* with an individual electrode 57 and a common electrode 59, as follows: piezoelectric body 58*a*, individual electrode 57, piezoelectric body 58*a*, common electrode 59, piezoelectric body 58*a*, and so on.

Furthermore, in the pressure chamber unit 54 of the print head (liquid ejection head) 50 according to the present embodiment, an elastic body 60 of rubber, resin, or the like, (having a Young's modulus of 0.1 GPa to 20 GPa) is disposed in the peripheral region of a diaphragm 56 excluding the central region which corresponds to the pressure chamber 52, and an laminated piezoelectric element 58 is formed thereon. In other words, an elastic body 60 having an opening section 60*a* is formed on the diaphragm 56 in the central part of the region corresponding to the pressure chamber 52, and a projection 58*b* formed on the piezoelectric body 58*a* on the lower section of the laminated piezoelectric element 58 is fitted into the opening section 60*a* of the elastic body 60, in such a manner that the projection 58*b* on the piezoelectric body 58*a* makes contact with the diaphragm 56. Consequently, the laminated piezoelectric element 58 makes contact with the diaphragm 56 by means of the projection 58*b* only. Furthermore, the elastic body 60 is disposed at the periphery of the projection 58*b* which forms the bonding section between the piezoelectric body 58*a* and the diaphragm 56.

Furthermore, the shape of the opening section 60*a* provided in the elastic body 60, in the central region of the pressure chamber 52, is not limited in particular, and it may be a circular shape, a quadrilateral shape, or a polygonal shape. Furthermore, even if the elastic body 60 is formed between the diaphragm 56 and the laminated piezoelectric element 58, its elastic properties do not affect the transmission of pressure from the laminated piezoelectric element 58 having a projecting shape (projection 58*b*) to the diaphragm 56.

Furthermore, the method of manufacturing the laminated piezoelectric element 58 having a projection 58*b* which makes partial contact with the diaphragm 56, on top of the diaphragm 56, will be described hereinafter, but after forming the laminated piezoelectric element 58, it is possible to leave the elastic body 60 in position, as shown in FIG. 5, or it is possible to remove the elastic body 60 after forming the laminated piezoelectric element 58.

If the elastic body 60 is to be removed after forming the laminated piezoelectric element 58, then rather than using an elastic body 60, it is possible to form the laminated piezoelectric element 58 using a dissolvable body, and to then remove the dissolvable body by dissolving. Furthermore, it is also possible to use another material, and to remove a portion thereof by cutting. Moreover, if the laminated piezoelectric element 58 is formed by aerosol deposition (AD), then a body functioning as a mask, such as a resist, for example, may be used.

The reason that an elastic body 60 having an opening section 60*a* in the central part of the region corresponding to the pressure chamber 52 is formed on the diaphragm 56 in this way, and the laminated piezoelectric element 58 is devised in such a manner that it makes contact with the diaphragm 56 only by means of a projection 58*b* corresponding to this opening section 60*a*, is because this causes the diaphragm 56 to move apparently at high frequency. This is described below.

Figure 6A:
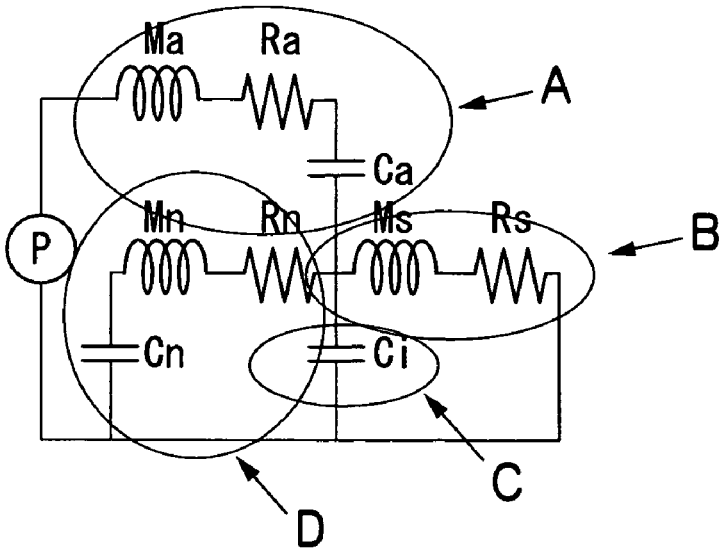
FIGS. 6A and 6B are circuit diagrams showing a lumped constant model of one nozzle in a print head.

FIG. 6A shows a lumped constant model of one nozzle 51 of a print head 50. In FIG. 6A, section A corresponds to an actuator (laminated piezoelectric element 58), section B corresponds to an ink supply port 53, section C corresponds to a pressure chamber 52, and section D corresponds to a nozzle 51.

Figure 6B:
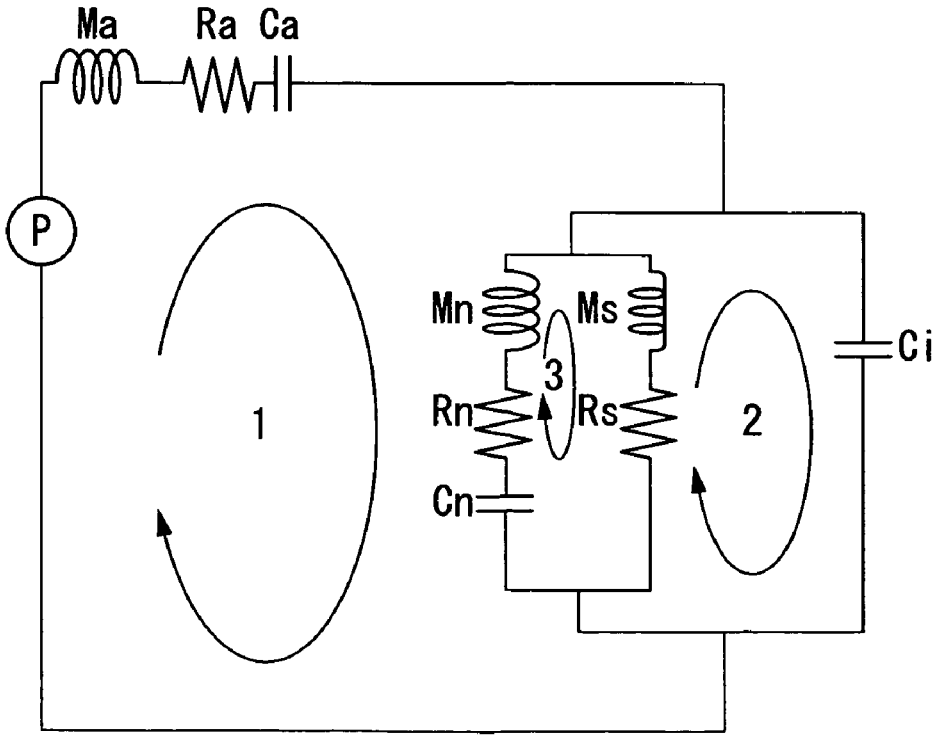

FIG. 6B shows a version of FIG. 6A rewritten in order to make it easier to understand. From the lumped constant circuit shown here, it can be seen that the print head 50 has resonance as indicated by the circular arrows marked 1 to 3 in FIG. 6B. Here, the arrow marked with reference numeral 1 indicates the resonance caused by the actuator (laminated piezoelectric element 58), the arrow marked with reference numeral 2 indicates the resonance caused by the liquid (ink) inside the pressure chamber 52, and the arrow marked with reference numeral 3 indicates the resonance caused by the surface tension due to change in the meniscus at the nozzle surface.

In the case of the resonance indicated by arrow 3, the compliance due to the surface tension at the nozzle surface is very high compared the other resonances, and the resonant frequency is sufficiently small compared to the circuits indicated by arrow 1 and arrow 2 that it can be ignored.

The resonances of the circuits indicated by arrow 1 and arrow 2 have a major effect on the pressure change at the nozzle surface, when their resonant frequencies are close to each other. To give a specific example, a problem arises in that a higher pressure than the pressure at the nozzle surface during ejection is generated after ejection, and this pressure causes ejection to occur at a time when it should not occur.

In this case, it is known that if the resonant frequencies of the circuit indicated by arrow 1 and the circuit indicated by arrow 2 are widely separated from each other, then problems of this kind do not occur, and therefore it is desirable that the resonant frequencies are set to as divergent values as possible.

FIGS. 7A to 7F show simulation results for the change in vibration when an actuator (laminated piezoelectric element 58) is pushed by a voltage of 10V, while varying the frequency of the actuator between 150 kHz and 1 MHz, at a uniform resonant frequency (100 kHz) of the pressure chamber 52.

In each of the graphs shown in FIGS. 7A to 7F, the very first peak (on the left-hand side) of the waveform indicates the principal ejection action. As shown in FIGS. 7A to 7C, if the frequency of the actuator is a low frequency of 150 kHz to 250 kHz, then following the first peak which indicates the principal ejection, a larger peak appears, which is an unintentional vibration, and therefore, ink is ejected when it is not supposed to be ejected.

In this way, if the frequency of the actuator is a low frequency of 250 kHz or less, then there is a possibility of unintentional ink ejection, due to the effects of the resonant frequency of the pressure chamber 52, but at a high frequency of 300 kHz or above, no ink ejection is observed. In the simulation shown in FIGS. 7A to 7F, no damping effects are introduced, and therefore the vibration continues for a long time. Furthermore, even if damping is introduced, vibration is difficult to restrict if the resonant frequencies are close together.

Figure 8A:
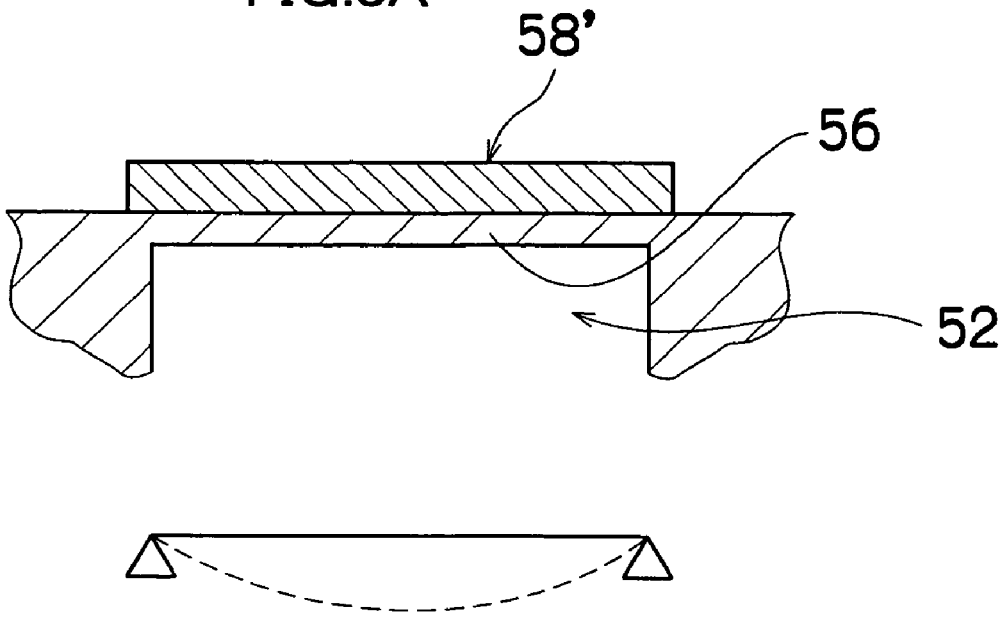
Figure 8B:
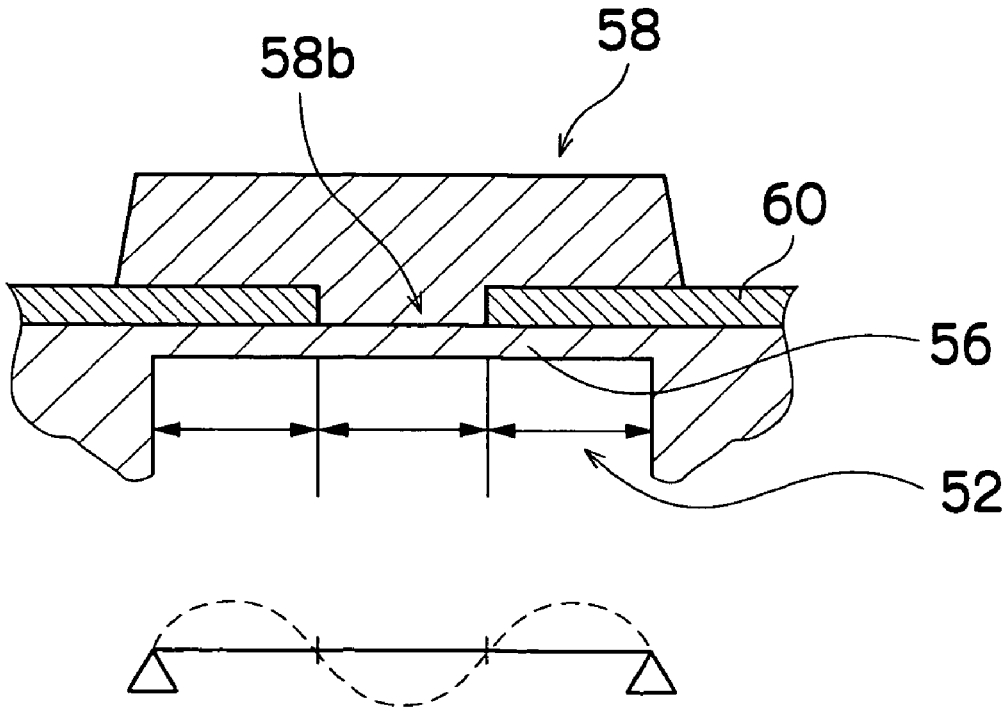

FIGS. 8A and 8B are illustrative diagrams showing fundamental vibration and third harmonic vibration. FIG. 8A shows a case of the fundamental vibration (first-order mode). As shown in FIG. 8A, a piezoelectric element 58' makes contact with the full surface of the diaphragm 56 provided on the upper surface of the pressure chamber 52. In this case, looking at the first-order example, as shown in the lower part of the diagram, the diaphragm 56 forms a beam (string) supported at both ends, and it vibrates to have a single antinode with the nodes at the two ends. The intrinsic drive frequency (basic frequency) of the piezoelectric element 58' in this case is $f_0$.

Furthermore, FIG. 8B shows a case of third-harmonic vibration (third-order mode). As shown in FIG. 8B, an elastic body 60 having an opening section in the central part of the pressure chamber is formed on the diaphragm 56, and a laminated piezoelectric element 58 having a projection 58*b* which fits into the opening section in the elastic body 60 is formed thereon, in such a manner that the projection 58*b* of the laminated piezoelectric element 58 makes contact with the diaphragm 56.

In this case, if the width of the projection 58*b* is ⅓ of the width of the pressure chamber 52, then in the case of the first-order example, as shown in the lower part of the diagram, the diaphragm 56 forms a beam (string) supported at both ends, and it vibrates to have three antinodes with the nodes at three equidistant positions. In this case, the vibration frequency of the diaphragm 56 becomes $3f_0$. In this way, even without increasing the frequency of the actuator (laminated piezoelectric element 58), it is possible to increase the apparent frequency of the diaphragm 56. In this beam model, the frequency in the third-order mode is exactly $3f_0$; and in the case of a square shape, rectangular shape, circular shape, or the like, which has a surface area, the frequency in the third-order mode will be approximately $3f_0$.

Therefore, in the present embodiment, the dimensions of the respective parts of the laminated piezoelectric element 58 are set as follows.

Figure 9:
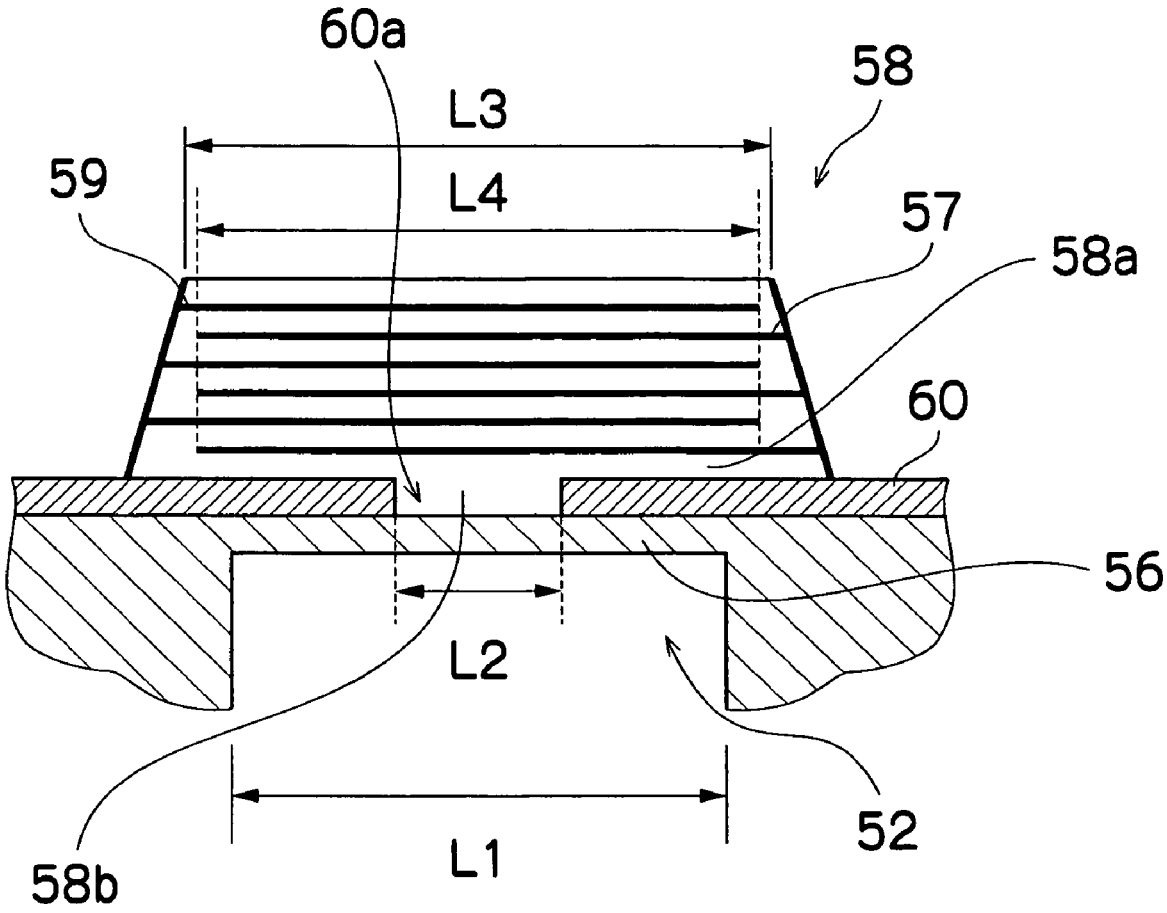
FIG. 9 is an enlarged cross-sectional diagram of a portion of the laminated piezoelectric element showing the dimensions thereof.

FIG. 9 is an enlarged view of the laminated piezoelectric element 58 in FIG. 5 and shows the dimensions thereof.

As shown in FIG. 9, the width of the pressure chamber 52 is L1, and the width of the opening section 60*a* of the elastic body 60, in other words, the width of the projection 58*b* of the laminated piezoelectric element 58 is L2. Furthermore, the width of the laminated piezoelectric element 58 is L3, and the width of the active section of the laminated piezoelectric element 58, which is the region where the individual electrode 57 and the common electrode 59 are overlapping, is L4.

In this case, firstly, the basic relationship L2<L1<L3 is established. In this case, L1 is made greater than L2 in order that, even if there is some degree of positional displacement during manufacture of the print head, the projection 58*b* of the laminated piezoelectric element 58 will at least be placed over the pressure chamber 52. Furthermore, L3 is made greater than L1 in order that a large proportion of the force generated by the laminated piezoelectric element 58 is transmitted to the pressure chamber 52.

Here, FIG. 9 is a cross-sectional diagram and shows the lengths of the various sections, but the relationship between the surface areas of the respective sections also obeys the inequality given above. In other words, the effective surface area of the diaphragm formed on the upper surface of the pressure chamber 52 corresponding to L1 is greater than the surface area of the bonding section between the projection 58*b* of the laminated piezoelectric element 58 and the diaphragm 56, which corresponds to L2. Furthermore, the surface area of the upper surface of the laminated piezoelectric element 58 which corresponds to L3 is greater than either of these.

Moreover, more desirably, the relationship L2<L1<L4 is established. By making L4 greater than L1 in this way, the surface area of the active section of the laminated piezoelectric element 58 is made greater than the surface area of the pressure chamber 52, and the force generated by the laminated piezoelectric element 58 is increased.

This can be expressed similarly in terms of surface areas, namely, the effective surface area of the diaphragm forming the upper surface of the pressure chamber 52, which corresponds to L1, is greater than the surface area of the bonding section between the projection 58*b* of the laminated piezoelectric element 58 corresponding to L2 and the diaphragm 56. Furthermore, the surface area of the active section of the laminated piezoelectric element 58, where the individual electrode 57 and the common electrode 59 are overlapping, which corresponds to L4, is greater than either of these surface areas. Below, any relationships relating to lengths may also be expressed as relationships between the surface areas corresponding to those lengths.

Moreover, to give a more detailed description, it is desirable that the relationship (L3/2)<L2<L1<L4<L3 is established. In other words, the lower limit of L2 is approximately one-half the value of L3.

Furthermore, one edge of the pressure chamber 52 is approximately 300 μm, and if it is considered that approximately 30 μm of positional error occurs during manufacture, then it is desirable that L2/L1<0.9, in order that the projection 58*b* of the laminated piezoelectric element 58 is situated reliably over the pressure chamber 52.

Furthermore, as described above, if the resonant frequency of the diaphragm 56 is close to the resonant frequency caused by the ink inside the pressure chamber 52, then there is a danger than this make give rise to unintentional ejection at the nozzle surface, thus affecting image quality. Therefore, in order to avoid this, it is necessary that the frequency of the diaphragm 56 is significantly different to that the resonant frequency of the pressure chamber 52.

Therefore, in order to drive the diaphragm 56 in a high harmonic mode, L2 is set to ⅓of the value of L1 (namely, L2=L1/3). Consequently, the diaphragm 56 is driven in a third-order mode and vibrates at a high-frequency which is approximately three times the fundamental frequency of the laminated piezoelectric element 58, and which differs greatly from the resonant frequency of the pressure chamber 52. Therefore, the occurrence of unintentional ejection can be prevented.

By driving the diaphragm 56 in a third-order mode by setting the width of the projection 58*b* of the laminated piezoelectric element 58 which makes contact with the diaphragm 56 to ⅓ of the width of the pressure chamber 52, it is possible to drive the diaphragm 56 at a high apparent frequency, without raising the drive frequency of the actual laminated piezoelectric element 58, and therefore, the frequency can be distanced from the resonant frequency of the pressure chamber 52, occurrence of large peaks following the principal ejection which exceed the level of the principal ejection can be avoided, and hence unintentional ejection can be prevented in a simple and straightforward manner.

FIG. 9 which has been described above is a cross-sectional diagram, but FIGS. 10A to 10E show conceptual diagrams of various resonance modes, observing the diaphragm 56 from the side of the piezoelectric element 58. The cross-sectional diagram in FIG. 9 corresponds to a cross-section along line A-A in each of the diagrams, FIG. 10A to FIG. 10E. Furthermore, the stripe patterns in FIGS. 10A to 10E indicate lines of equal amplitude, and the thick lines N indicate the nodes of the vibration.

Figure 10A:
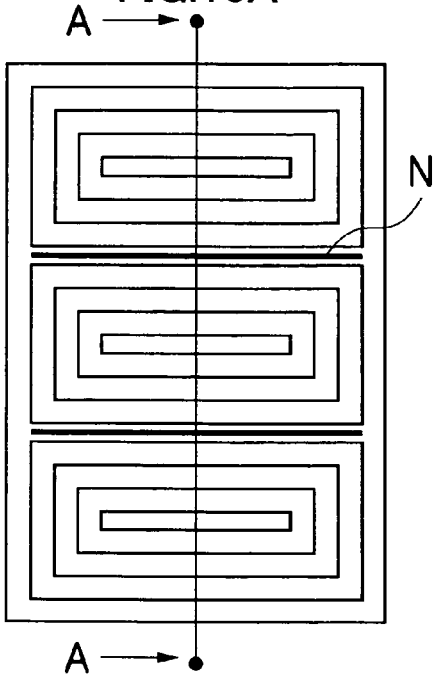
FIGS. 10A to 10E are conceptual diagrams showing various vibration modes of a diaphragm when viewed from the side of the piezoelectric element.
Figure 10D:
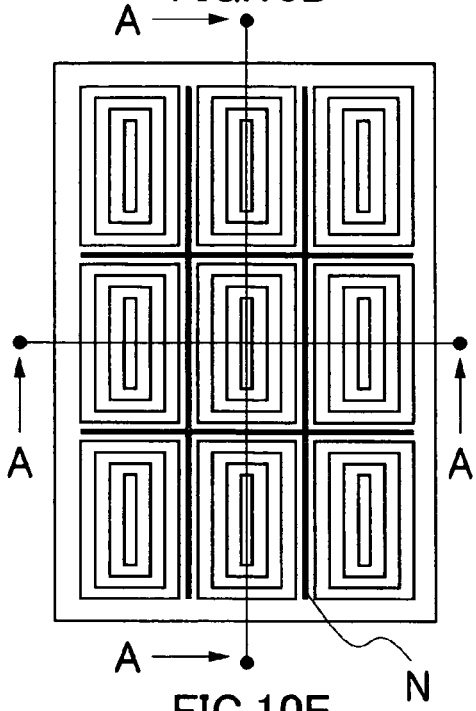
Figure 10B:
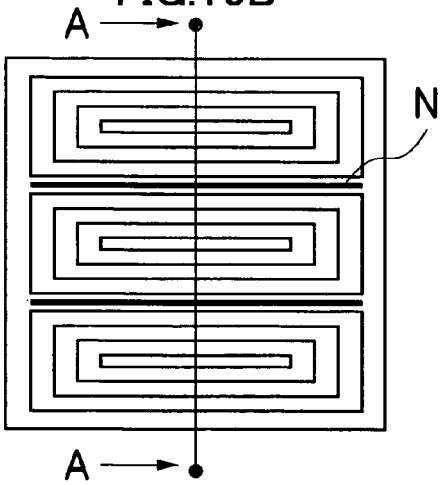

FIG. 10A shows a third-order mode in the case of a rectangular shape, and FIG. 10B shows a third-order mode in the case of a square shape. Furthermore, FIG. 10C shows a third-order mode in the case of a circular shape.

Figure 10E:
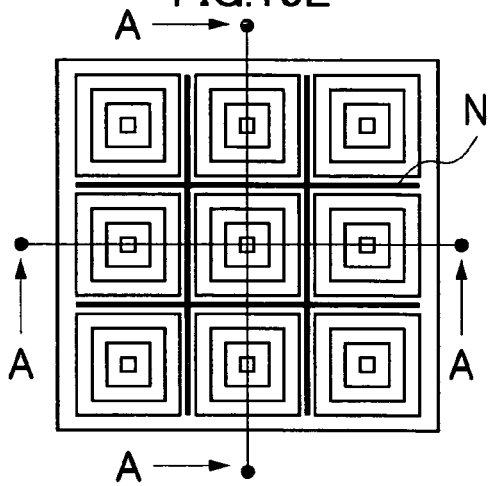
Figure 10C:
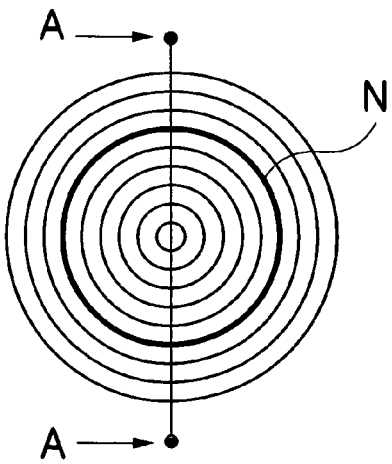

FIG. 10D shows a ninth-order mode in the case of a rectangular shape, and FIG. 10E shows a ninth-order mode in the case of a square shape.

Next, a method of manufacturing a print head (liquid ejection head) 50 having a laminated piezoelectric element 58 of this kind will be described.

FIGS. 11A to 11H show steps for manufacturing a print head 50, in sequence.

Figure 11A:
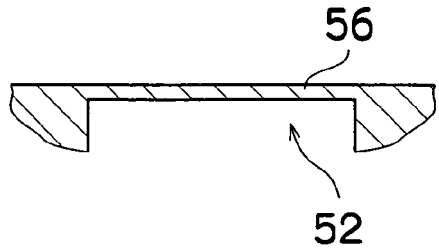
FIGS. 11A to 11H are process step diagrams showing a method of manufacturing a laminated piezoelectric element according to the present embodiment.

Firstly, as shown in FIG. 11A, a pressure chamber 52 having a nozzle 51 and common flow channel 55 (omitted from FIG. 11A), and a diaphragm 56 on the upper surface, is formed. There are no particular limitations on the flow channel structure of the method of manufacture up to this point, and any suitable method may be used. For example, a nozzle plate formed with nozzle holes, a flow channel plate having openings for pressure chambers and flow channels, and a thin film forming a diaphragm, may be laminated together, or alternatively, pressure chambers may be formed in a silicon substrate by cutting, based on etching or the like, and a nozzle plate and a diaphragm may be bonded to this substrate.

Figure 11B:
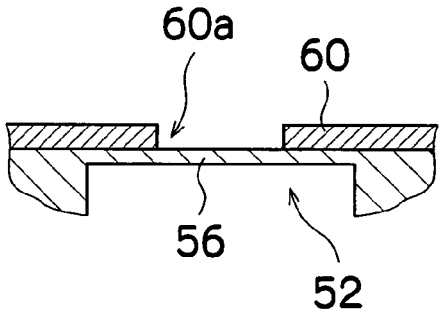

Next, as shown in FIG. 11B, an elastic body 60 is formed on top of the diaphragm 56 which constitutes the upper surface of the pressure chamber 52. This elastic body 60 has an opening section 60*a* in the central part of the region corresponding to the pressure chamber 52. As stated previously, if this body is to be removed subsequently, then it is possible to use a dissolvable body, such as resist, instead of the elastic body 60.

Figure 11C:
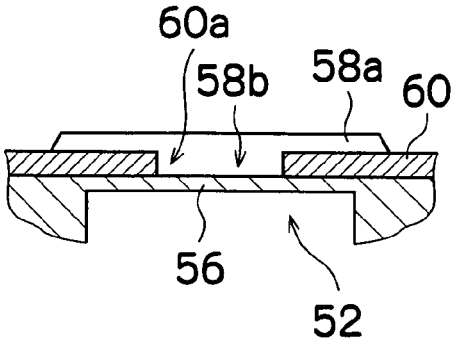

Next, as shown in FIG. 11C, a piezoelectric body 58*a* is formed thereon by aerosol deposition. In this, a projection 58*b* of the piezoelectric body 58*a* is formed, having a shape which projects toward the diaphragm 56, in the opening section 60*a* of the elastic body 60.

Here, since a piezoelectric body 58*a* cannot be grown on the elastic body 60 by means of aerosol deposition, it is desirable to deposit a highly rigid thin film, such as a film of Ni, Cr, W or DLC ("diamond-like carbon"), on the elastic body 60, to a thickness of approximately 0.1 μm to 10 μm, and preferably, approximately 1 μm to 2 μm. Thereby, the piezoelectric material can be deposited reliably without rebounding of the particles, when forming the piezoelectric body 58*a*.

Figure 11D:
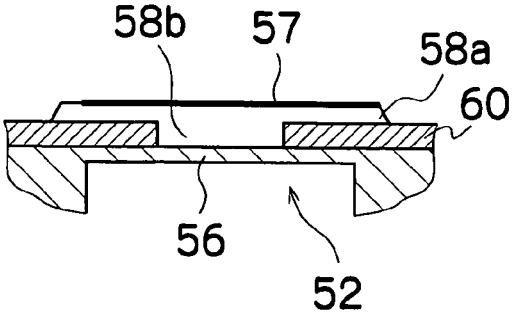

Next, as shown in FIG. 11D, an electrode (individual electrode) is formed by sputtering or plating onto the piezoelectric body 58*a* formed by aerosol deposition.

Figure 11E:
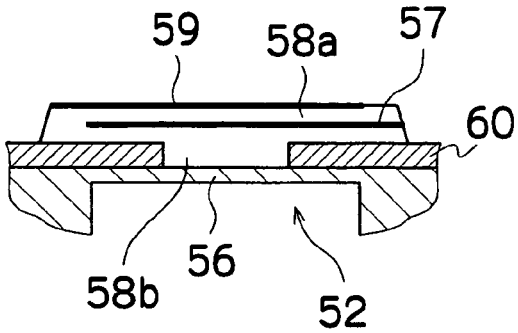

Thereupon, as shown in FIG. 11E, a second layer of piezoelectric body 58*a* is formed on top of the individual electrode 57, by aerosol deposition, and a second layer of electrode (common electrode 59) is formed on top of this layer.

Figure 11F:
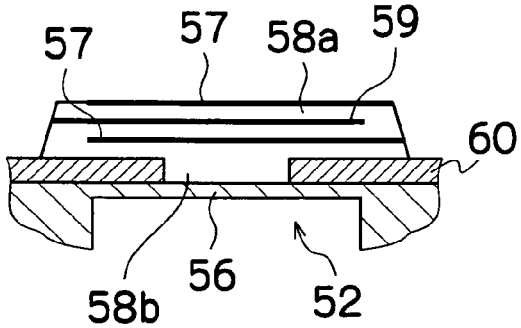

Next, as shown in FIG. 11F, a third layer of piezoelectric body 58*a* is formed thereon by aerosol deposition, and a third layer of electrode (individual electrode 57) is formed on top of this layer.

Figure 11G:
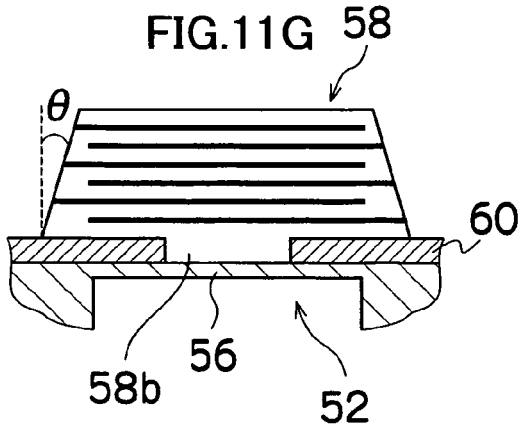

In this way, the fabrication of the laminated piezoelectric element 58 is completed, as shown in FIG. 11G, by forming respective layers, sequentially, using aerosol deposition. In this case, electrodes can be deposited on the side faces of the laminated layers, by sputtering from above or the like, if the surface area of the laminated layers (namely, the area parallel to the diaphragm 56) is reduced successively in the upward direction, while sandwiching the respective electrodes (the independent electrodes 57 and the common electrode 59). For example, desirably, the angle θ of the inclined surface is approximately 1° to 20°, as shown in FIG. 11G.

Figure 11H:
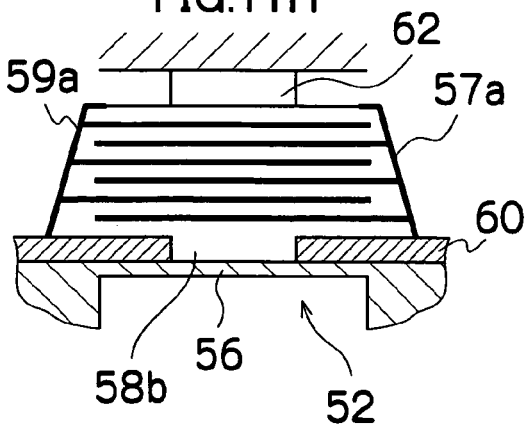

Finally, as shown in FIG. 11H, electrodes 57*a* and 59*a* are formed on the side faces by sputtering, or the like, from above, for instance, and a pressing member 62 for use when the laminated piezoelectric element 58 deforms is formed on top of the laminated piezoelectric element 58.

In forming a print head 50 such as that shown in FIG. 3, where pressure chamber units 54 formed in this way are arranged in a matrix configuration, a plurality of lines, each comprising pressure chamber units 54 aligned in one row, are arranged in parallel with each other. In each row, the common electrodes 59 which are extracted from the side faces of the laminated piezoelectric elements 58 in the pressure chamber units 54 are extracted from the end of each row, and combined into one wire.

Figure 12:
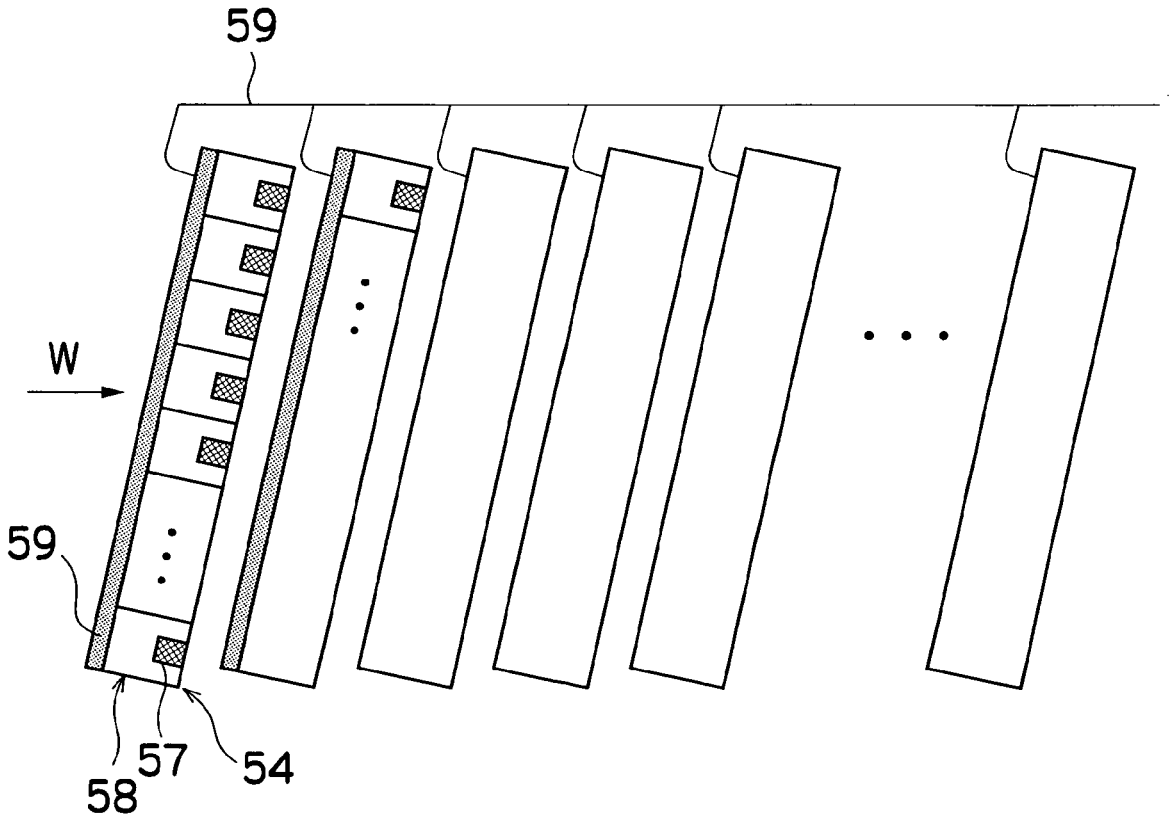
FIG. 12 is an illustrative diagram showing a state where pressure chamber units manufactured by the method shown in FIGS. 11A to 11H are arranged in a matrix fashion.
Figure 13A:
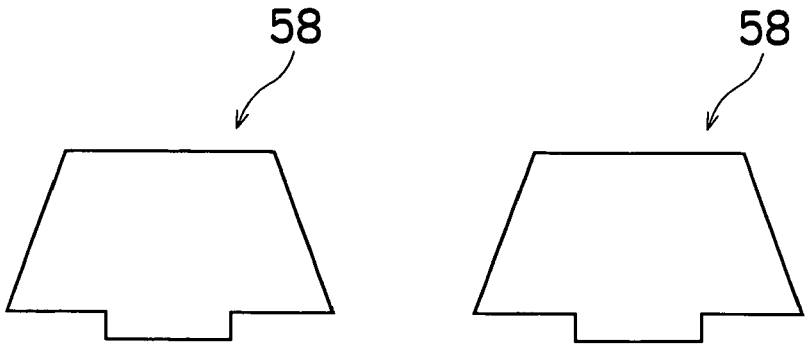
Figure 13B:
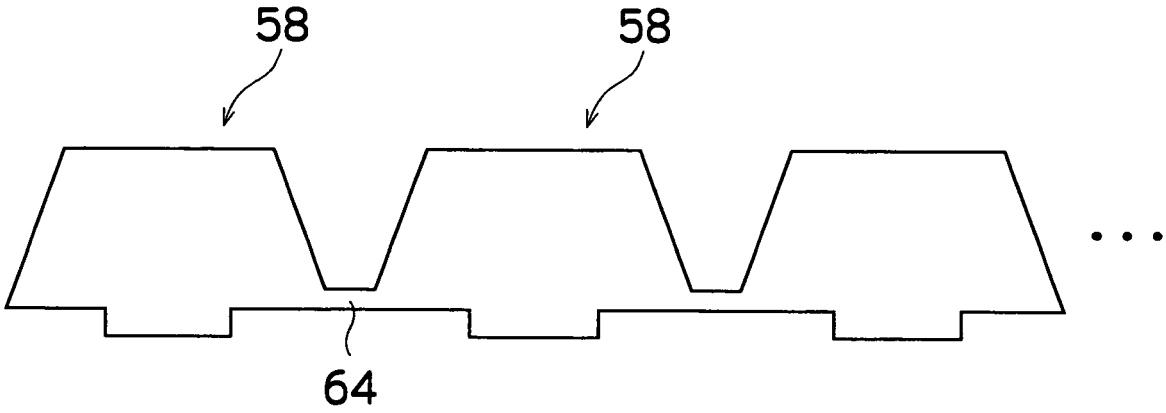

In this case, FIGS. 13A and 13B show the aspect, viewed in the direction of arrow W in FIG. 12, of a method for forming line-shaped laminated piezoelectric elements 58 for an arrangement where respective pressure chamber units 54 are arranged in one row as shown in FIG. 12. When forming by aerosol deposition, the line-shaped piezoelectric elements 58 may be previously formed separately and then aligned with each other, as shown in FIG. 13A, or the individual laminated piezoelectric elements 58 may be formed in a unified fashion in the lower part 64, as shown in FIG. 13B, in order to extract the common electrodes.

As described above, according to the present invention, a laminated piezoelectric element is formed by direct growth on a diaphragm, using aerosol deposition, and therefore, there is no need to bond the diaphragm to the piezoelectric body, adhesive characteristics are excellent, and there is no concern regarding detachment (peeling apart). Consequently, the reliability of the diaphragm can be improved.

Furthermore, when forming a laminated piezoelectric element on a diaphragm by aerosol deposition, since the surface area (in the direction perpendicular to the direction of lamination) is reduced gradually in the upward direction of lamination (in the direction to recede from the diaphragm), it is possible to form side face electrodes by means of sputtering, or the like, from above, onto the inclined surfaces of the laminated piezoelectric element.

Moreover, since the lower central portion of the piezoelectric element is formed into a projecting shape in the direction of the diaphragm, then even if there is positional displacement with respect to the pressure chamber, the laminated piezoelectric element will press reliably on the diaphragm, and therefore, will be able to generate pressure in the pressure chamber.

Furthermore, the surface area of the active section of the laminated piezoelectric element can be increased, and a large force can be obtained from the element. Moreover, since an elastic body or dissolvable body formed with a highly rigid thin film is disposed on the surface of the diaphragm, in the periphery of the projection on the laminated piezoelectric element, then it is possible to form the laminated piezoelectric element directly onto the diaphragm by aerosol deposition.

In the case of line-shaped laminated piezoelectric elements having unified lower parts, it is possible to extract the common electrodes readily from the end section thereof.

Furthermore, by setting the width of the projection of the laminated piezoelectric element to ⅓ of the width of the pressure chamber, it is possible to make the diaphragm vibrate at a frequency approximately three times higher than the basic frequency of the laminated piezoelectric element, by causing it to vibrate in third-order mode. Accordingly, it is possible to increase the resonant frequency of the diaphragm, and therefore, unintentional ejection due to resonance with the pressure chamber is prevented, and ejection can be stabilized.

If the diaphragm is vibrated at high frequency, then it is also possible to make it vibrate by ninth-order vibration, rather than third-order vibration as described above.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection head, comprising:

a nozzle through which liquid is ejected;

a pressure chamber which is connected to the nozzle;

a diaphragm which pressurizes the pressure chamber; and a laminated piezoelectric element which causes the diaphragm to deform and is bonded to a section of the diaphragm by means of a thin film forming technique, wherein:

an effective surface area of the diaphragm forming one inner surface of the pressure chamber is greater than a surface area of the bonding section between the diaphragm and the laminated piezoelectric element;

a surface area of an active section of the laminated piezoelectric element is greater than the effective surface area of the diaphragm;

a width of the bonding section between the diaphragm and the laminated piezoelectric element through which the laminated piezoelectric element directly presses is ⅓an effective width of the diaphragm; and the laminated piezoelectric element has a projection on a lower section which corresponds with the bonded section between the diaphragm and the laminated piezoelectric element, the projection being in contact with the diaphragm, and cross-sectional areas extending on planes parallel to the diaphragm, and the larger a distance from the diaphragm to the plane is, the smaller the cross-sectional area of the laminated piezoelectric element extending on the plane becomes.

2. The liquid discharge head as defined in claim 1, wherein the thin film forming technique is an aerosol deposition method.

3. The liquid ejection head as defined in claim 1, wherein a plurality of laminated piezoelectric elements are integrated on diaphragm sides thereof so as to correspond to a plurality of pressure chambers.

4. The liquid ejection head as defined in claim 1, further comprising an elastic member which is disposed in a periphery of the bonding section between the laminated piezoelectric element and the diaphragm.

5. An image forming apparatus, comprising the liquid ejection head as defined in claim 1.

* * * * *